US012618653B2

(12) United States Patent
Kramer

(10) Patent No.: US 12,618,653 B2
(45) Date of Patent: May 5, 2026

(54) MAGAZINE RETENTION SYSTEMS

(71) Applicant: Greggory Charles Kramer, Sheridan, OR (US)

(72) Inventor: Greggory Charles Kramer, Sheridan, OR (US)

( * ) Notice: Subject to any disclaimer, the term of this patent is extended or adjusted under 35 U.S.C. 154(b) by 25 days.

(21) Appl. No.: 18/796,157

(22) Filed: Aug. 6, 2024

(65) Prior Publication Data

US 2025/0085092 A1 Mar. 13, 2025

Related U.S. Application Data

(60) Provisional application No. 63/537,112, filed on Sep. 7, 2023.

(51) Int. Cl.

| | |
|---|---|
| ***F42B 39/02*** | (2006.01) |
| ***A45F 3/00*** | (2006.01) |
| ***F42B 39/26*** | (2006.01) |

(52) U.S. Cl.

CPC ..... *F42B 39/02* (2013.01); *F42B 39/26* (2013.01); *A45F 2003/003* (2013.01)

(58) Field of Classification Search

CPC .... F42B 39/02; F42B 39/26; A45F 2003/003; A45F 5/021

See application file for complete search history.

(56) References Cited

U.S. PATENT DOCUMENTS

2016/0327382 A1* 11/2016 Beck ..... A45C 7/0063

* cited by examiner

*Primary Examiner* — Andrew D Perreault

(74) *Attorney, Agent, or Firm* — Mohr Intellectual Property Law Solutions, PC

(57) ABSTRACT

Magazine retention systems including a pouch, an anchor, an elastic cord, and a tension adjuster. The pouch defines a pouch interior and is configured to receive an ammunition magazine. The pouch includes sidewalls and a floor. The sidewalls define a pouch opening through which the ammunition magazine may be selectively placed within the pouch interior. The floor is coupled to the sidewalls opposite the pouch opening and cooperates with the sidewalls to define the pouch interior. The anchor is coupled to the pouch. The elastic cord is secured to the anchor and extends around the sidewalls. The tension adjuster is mounted to the elastic cord. The tension adjuster maintains the elastic cord under a selected tension. The tension adjuster and the elastic cord cooperate to selectively compress the sidewalls to secure the ammunition magazine inside the pouch interior.

18 Claims, 10 Drawing Sheets

MAGAZINE RETENTION SYSTEMS

CROSS REFERENCE TO RELATED APPLICATIONS

This application claims priority to copending U.S. application, Ser. No. 63/537,112, filed on Sep. 7, 2023, which is hereby incorporated by reference for all purposes.

BACKGROUND

The present disclosure relates generally to retention systems. In particular, ammunition magazine retention systems are described.

Systems to retain items are important when carrying or traveling with items. Securely retaining an item is especially important when moving is likely to subject the items to jostling or inversion. Jostling or inverting an unsecured item creates a risk of damaging or losing the item.

Soldiers or firearm owners carrying ammunition magazines in pouches is an example where securing an item is important. An ammunition magazine disposed within a pouch without a retainer of some kind is prone to falling out of the pouch. The risk of losing an ammunition magazine increases when a soldier is running between positions or crawling through foliage. A soldier losing an ammunition magazine can subject the solider to mortal harm and/or jeopardize a mission.

Conventional systems to retain ammunition magazines in pouches have various shortcomings. For example, systems described in U.S. Pat. Nos. 9,759,536B2, 9,394,080B2, and US20230080751A1 provide limited retention capabilities and are insufficiently adjustable. In particular, conventional magazine retainer systems lack means to adjustably and circumferentially retain magazines independent of means to retain magazines from the top of the magazines.

For example, each of the listed patent filings above disclose magazine retainer systems that rely on a single elastic cord routed over and around a magazine within a pouch. The tension in the elastic cord can be adjusted, but the tension is universal above and around the magazine in the pouch. In the conventional magazine retainer systems, it is not possible to independently adjust the tension of a cord extending circumferentially around the magazine separate from the tension of a cord extending over the top of the magazine.

Thus, there exists a need for magazine retainer systems that improve upon and advance the design of known magazine retainer systems. Examples of new and useful magazine retainer systems relevant to the needs existing in the field are discussed below.

Disclosure relevant to magazine retainer systems is included in the following U.S. Patent References: U.S. Pat. Nos. 9,759,536B2, 9,394,080B2, and US20230080751A1. The complete disclosures of the above patents and patent applications are herein incorporated by reference for all purposes.

SUMMARY

The present disclosure is directed to magazine retention systems including a pouch, an anchor, an elastic cord, and a tension adjuster. The pouch defines a pouch interior and is configured to receive an ammunition magazine in the pouch interior.

The pouch includes sidewalls and a floor. The sidewalls define a pouch opening through which the ammunition magazine may be selectively placed within the pouch interior. The floor is coupled to the sidewalls opposite the pouch opening and cooperates with the sidewalls to define the pouch interior.

The anchor is coupled to the pouch. The elastic cord is secured to the anchor and extends around the sidewalls.

The tension adjuster is mounted to the elastic cord along the length of the elastic cord. The tension adjuster is configured to maintain a stretched portion of the elastic cord under a selected tension by selectively restricting the elastic cord from moving relative to the tension adjuster. The tension adjuster and the elastic cord cooperate to selectively compress the sidewalls to secure the ammunition magazine inside the pouch interior.

DETAILED DESCRIPTION

Figure 1:
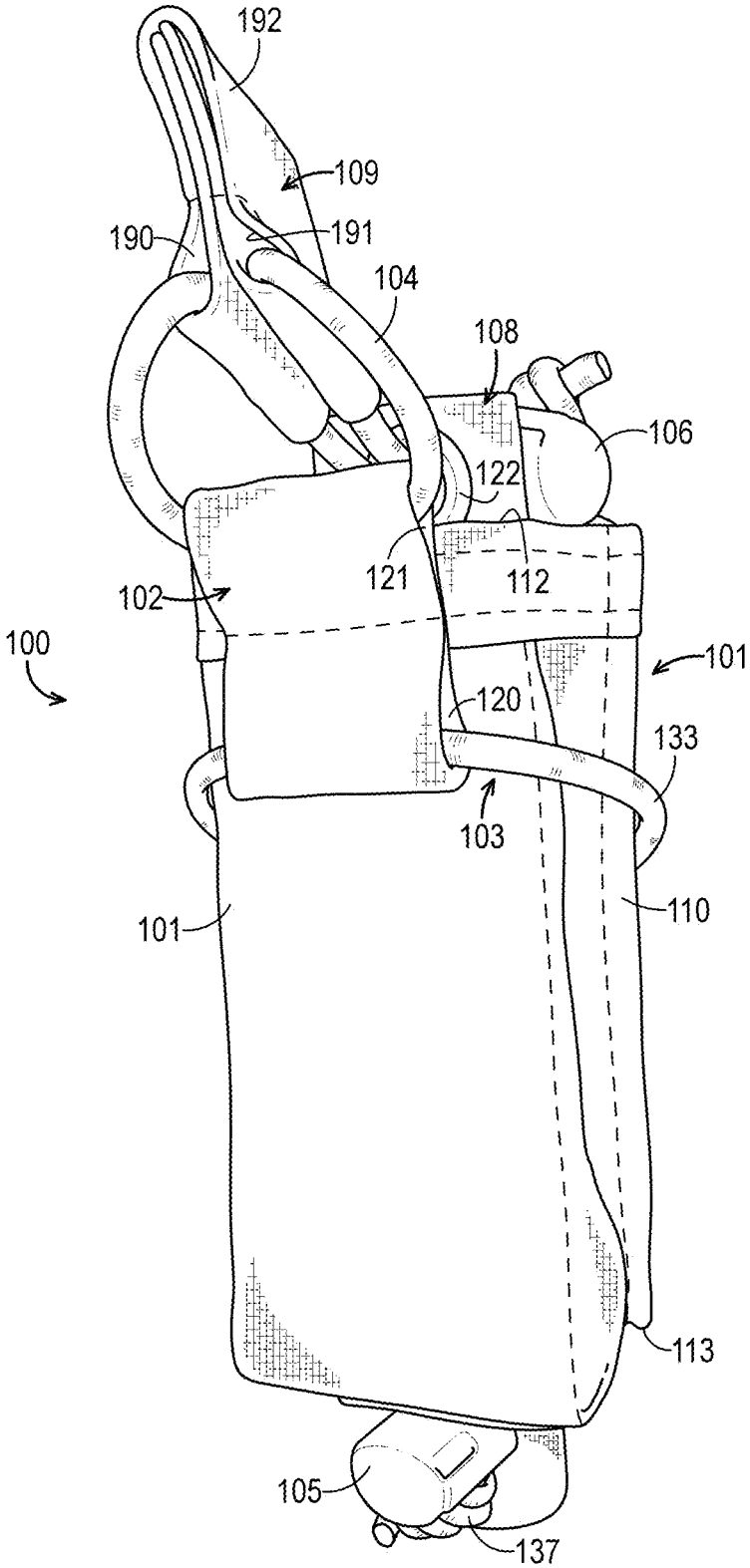
FIG. 1 is a front perspective view of a first embodiment of a magazine retention system.

The disclosed magazine retention systems will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various magazine retention systems are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Definitions

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional elements or method steps not expressly recited.

Terms such as "first", "second", and "third" are used to distinguish or identify various members of a group, or the like, and are not intended to denote a serial, chronological, or numerical limitation.

"Coupled" means connected, either permanently or releasably, whether directly or indirectly through intervening components.

Contextual Details

Ancillary features relevant to the magazine retention systems described herein will first be described to aid discussing the magazine retention systems.

Ammunition Magazine

The magazine retention systems disclosed herein are typically used to retain ammunition magazines within pouches, but may be used to retain a wide variety of other items as well within the pouch. FIGS. 7-10 depict a variety of suitable ammunition magazines.

The reader can see in FIGS. 7-10 that the ammunition magazines have different sizes and shapes. Magazines suitable for different firearms will typically have different sizes and shapes. The magazine retention systems described herein are adjustable to accommodate magazines of different sizes, shapes, and types.

Magazine Retention Systems

With reference to the figures, magazine retention systems will now be described. The magazine retention systems discussed herein function to retain ammunition magazines within a pouch by adjustably compressing the front, back, and sides of the magazine independent of tension in any optional retention members pressing on the magazine from above.

The reader will appreciate from the figures and description below that the presently disclosed magazine retention systems address many of the shortcomings of conventional magazine retention systems. For example, the novel magazine retention systems described herein include means to adjustably and circumferentially retain magazines independent of means to retain magazines from the top of the magazines. The novel magazine retention systems described in this document are more sophisticated than conventional systems that rely on a single elastic cord routed over and around a magazine within a pouch. With the novel magazine retention systems discussed below, one can independently adjust the tension of a cord extending circumferentially around the magazine in a pouch separate from the tension of a cord extending over the top of the magazine.

Magazine Retention System Embodiment One

With reference to FIGS. 1-3, and 10, a first example of a magazine retention system, magazine retention system 100, will now be described. Magazine retention system 100 includes a pouch 101, a first anchor 102, a cord router 109, a first elastic cord 103, a second elastic cord 104, a first tension adjuster 105, a second tension adjuster 106, a coupler 107, and a second anchor 108.

In some examples, the magazine retention system does not include one or more features included in magazine retention system 100. For example, some magazine retention system examples do not include second elastic cord 104, second tension adjuster 106, coupler 107, second anchor 108, and/or cord router 109. In other examples, the magazine retention system includes additional or alternative features.

Pouch

Pouch 101 functions to flexibly contain a magazine or other items. Pouch 101 also supports first anchor 102 and cooperates with the elastic cords to retain the magazine or other items.

Figure 2:
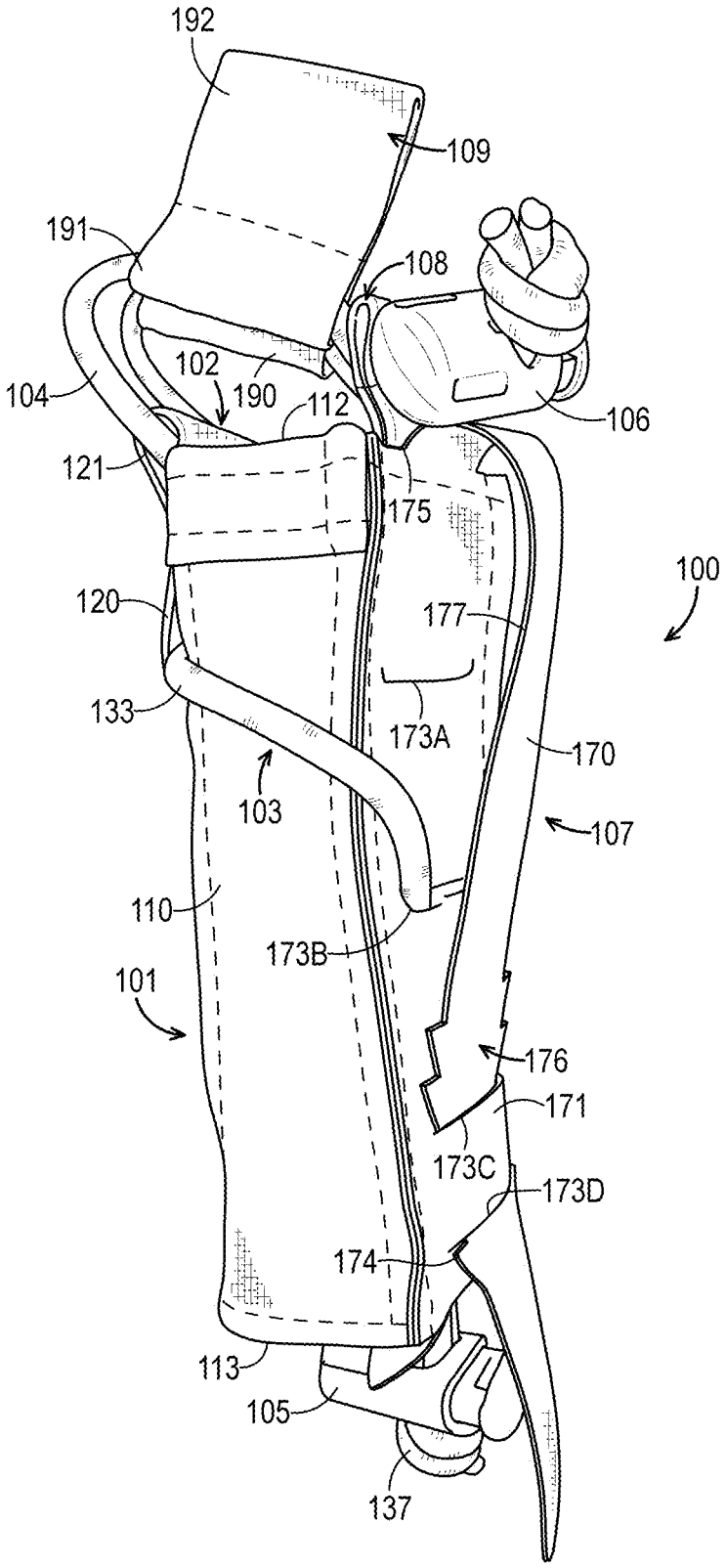
FIG. 2 is a side view of the magazine retention system shown in FIG. 1.
Figure 3:
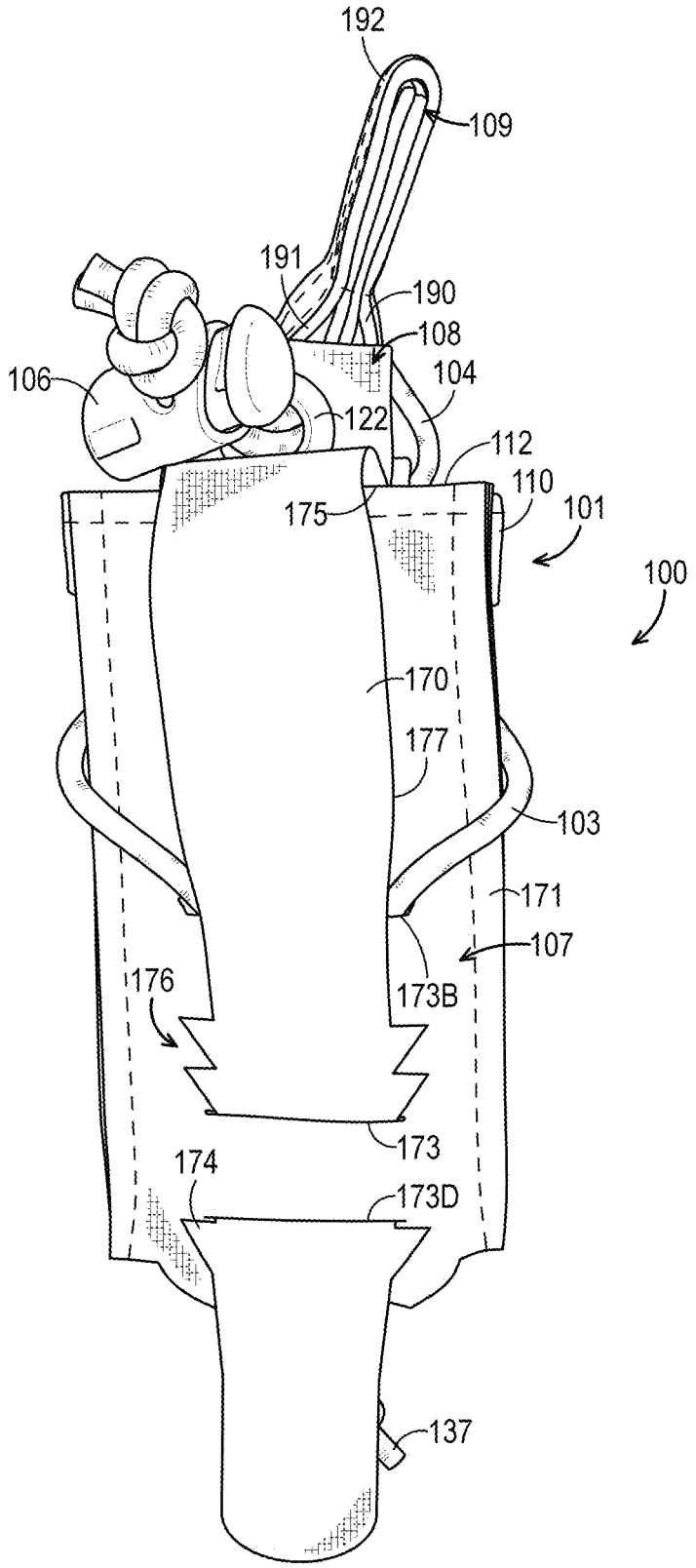
FIG. 3 is a rear view of the magazine retention system shown in FIG. 1.
Figure 4:
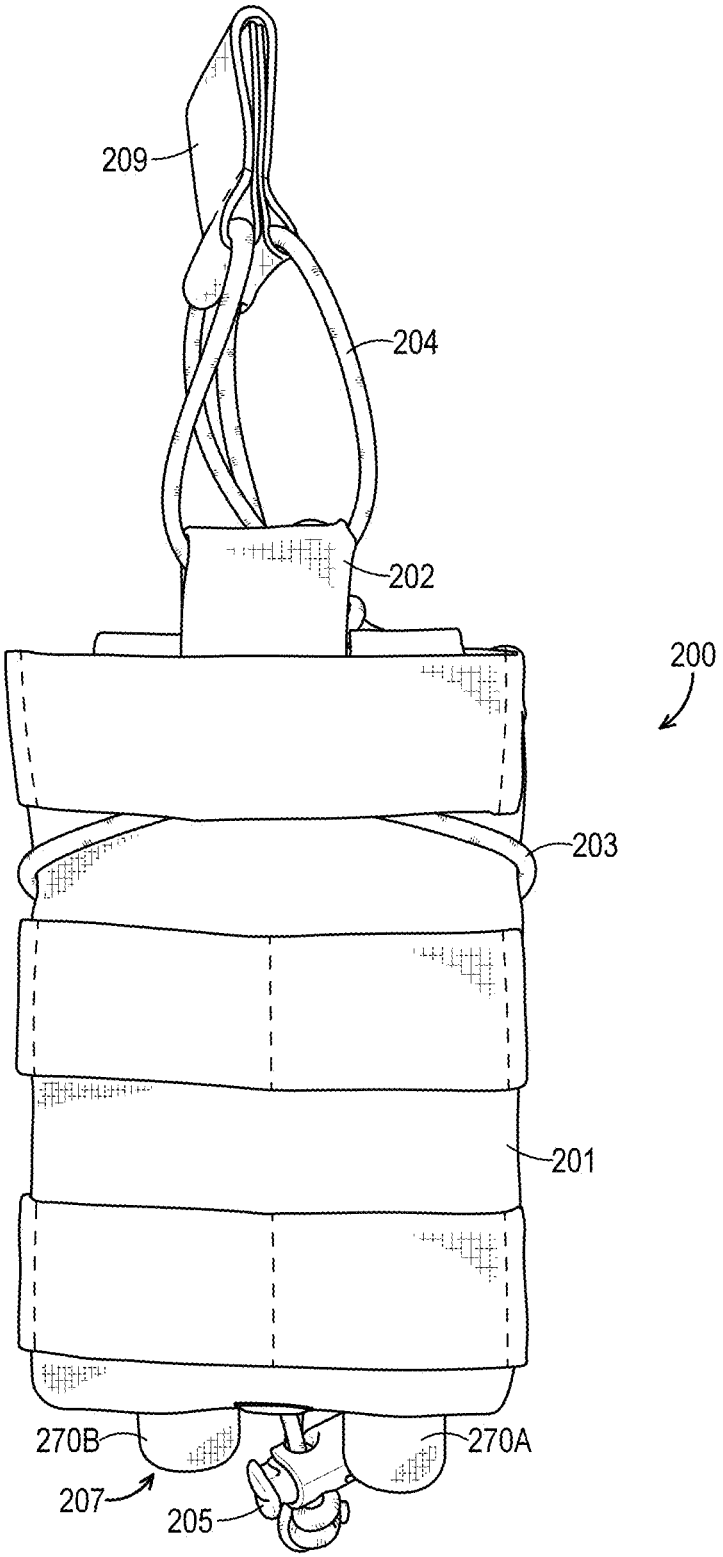
FIG. 4 is a front view of a second embodiment of a magazine retention system.
Figure 5:
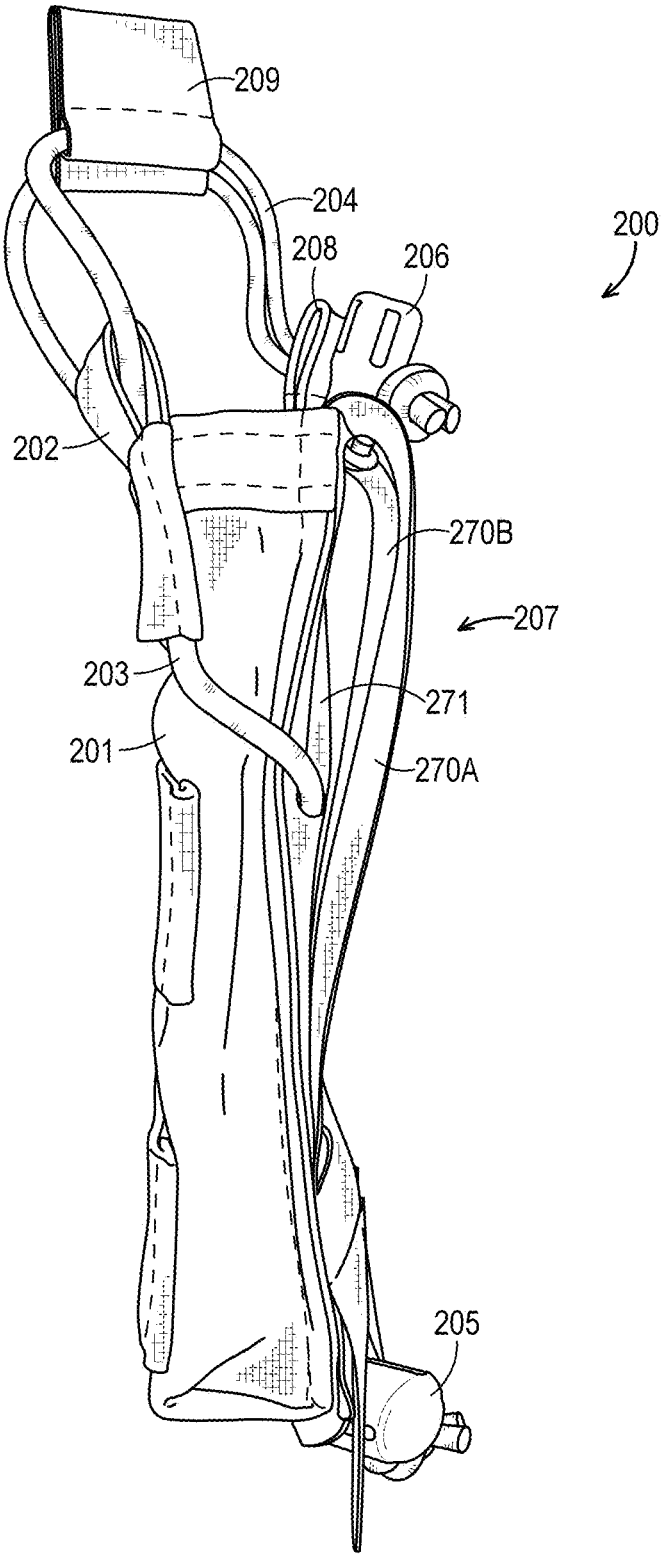
FIG. 5 is a side view of the magazine retention system shown in FIG. 4.

As can be seen in FIGS. 1-3, pouch 101 includes a floor 113 and sidewalls 110. Pouch 101 defines a pouch interior bounded by floor 113 and sidewalls 110. Floor 113 and sidewalls 110 cooperate to define the pouch interior.

As depicted in FIGS. 1-3, sidewalls 110 are formed from a fabric expanse and define a pouch opening 112. Floor 113 is coupled to sidewalls 110 opposite pouch opening 112. Pouch 101 has a pouch length extending from pouch opening 112 to floor 113.

The pouch interior is accessible via pouch opening 112. As is readily apparent from FIGS. 9 and 10, one may insert a magazine into the pouch interior through pouch opening 112.

The pouch may be formed from any currently known or later developed material suitable for flexibly supporting a magazine or other items. Suitable materials include durable fabric materials made from polyester or other polymers; cotton or cotton blends; or animal hides, such as leather or burlap. Any type of man-made or natural materials may be used.

In some examples, the pouch includes an underlying hard plastic material covered on both sides with a durable fabric material. The hard plastic material provides a reinforcing backing structure to provide structural strength and integrity to the pouch body.

The reader can see in FIG. 1 that first anchor 102 is sewn to pouch 101 to couple first anchor 102 to pouch 101. In the present example, first anchor 102 is sewn to a front side of pouch 101 near pouch opening 112. However, the first anchor may be sewn or otherwise coupled to the pouch in other locations as well.

With reference to FIGS. 1-3, 9, and 10, the reader can see that first elastic cord 103 wraps around pouch 101 to retain the magazine in pouch 101. In particular, first elastic cord 103 wraps around a front of pouch 101 through first anchor 102, around both lateral sides of pouch 101, and then down the back of pouch 101 through openings in coupler 107. First elastic cord 103 is secured with a desired tension around pouch 101 with first tension adjuster 105. The first elastic cord may wrap around the pouch in different paths to modify the manner in which the first elastic cord retains the magazine in the pouch.

Anchors

First anchor 102 functions to anchor first elastic cord 103 at a desired position on pouch 101. In the present example, first anchor 102 also functions to anchor second elastic cord 104 at a desired position on pouch 101. Second anchor 108 also functions to anchor second elastic cord 104 at a desired position on pouch 101.

As shown in FIG. 1, first anchor 102 and second anchor 108 are sewn to pouch 101. In the present example, first anchor 102 is sewn to a front side of pouch 101 near pouch opening 112 and second anchor 108 is sewn to a rear side of pouch 101 near pouch opening 112. Second anchor 108 is thus coupled to pouch 101 in a position spaced across pouch opening 112 from first anchor 102. However, the first anchor and tab may be sewn or otherwise secured to the pouch in other locations as well.

In the example shown in FIG. 1, first anchor 102 is sewn to pouch 101 in a way that defines two loops: a bottom loop 120 and a top loop 121. The top and bottom loops define parallel, laterally extending channels. First elastic cord 103 extends through bottom loop 120 of first anchor 102 and second elastic cord 104 extends through top loop 121 of first anchor 102. Bottom loop 120 retains a medial portion of first elastic cord 103 and top loop 121 retains a medial portion of second elastic cord 104.

Second anchor 108 defines an eyelet 122 through which two ends of second elastic cord 104 extend. Second tension adjuster 106 is disposed near eyelet 122 of second anchor 108 to secure the ends of second elastic cord 104 together with a desired amount of tension. Eyelet 122 defines an opening that is smaller than second tension adjuster 106 to restrict second tension adjuster 106 from passing through eyelet 122.

The anchors are formed from 1 inch military specification nylon webbing material, but may be formed from any durable and flexible material suitable for forming loops. The anchors may be formed from any currently known or later developed material suitable for forming a structural anchor for an elastic cord when attached to a pouch and/or for retaining portions of an elastic cord. The size and the shape of the anchors may be selected to meet the needs of a given application.

Cord Router

Cord router 109 serves to retain two portions of second elastic cord 104 in close proximity above pouch opening 112 to facilitate pressing on the top of a magazine inserted into pouch 101. Cord router 109 is not sewn to pouch 101 and instead is supported on second elastic cord 104. In particular, cord router 109 is mounted to second elastic cord 104 above pouch opening 112.

The reader can see in FIG. 1 that cord router 109 forms two parallel channels: a first channel 190 and a second channel 191. First channel 190 and second channel 191 extend in a front-to-back direction relative to pouch 101.

Two portions of second elastic cord 104 extend through the two parallel channels defined by cord router 109 while a third portion extends through the top channel of first anchor 102. Cord router 109 holds the two portions of second elastic cord 104 close together above pouch 101. The elastic cord portions running parallel in close proximity through cord router 109 above pouch opening 112 effectively creates a cover or pushing member pushing the magazine further into pouch 101.

As shown in FIGS. 1-3, 9, and 10, cord router 109 includes a pull tab 192. Pull tab 192 extends transverse above first channel 190 and second channel 191. Second elastic cord 104 extending through first channel 190 and second channel 191 is disposed between pull tab 192 and pouch opening 112. As a result, pulling pull tab 192 away from pouch opening 112 spaces second elastic cord 104 from the ammunition magazine disposed in pouch 101. Spacing elastic cord 104 from the ammunition magazine by pulling pull tab 192 allows the ammunition magazine to be selectively removed from pouch 101.

Cord router 109 is formed from 1 inch military specification nylon webbing material, but may be formed from any durable and flexible material suitable for forming channels. The cord router may be formed from any currently known or later developed material suitable for routing and/or retaining portions of an elastic cord. The size and the shape of the cord router may be selected to meet the needs of a given application.

Elastic Cords

The elastic cords serve to retain a magazine or other items within pouch 101 by pressing on the magazine. First elastic cord 103 presses pouch 101 against the magazine inside pouch 101 to restrict the magazine from moving relative to pouch 101. Second elastic cord 104 presses the magazine into pouch 101 from above to retain the magazine within the pouch interior.

As shown in FIGS. 1-3, 9, and 10, first elastic cord 103 wraps around sidewalls 110 of pouch 101 to retain the magazine in pouch 101. First elastic cord 103 is retained by first anchor 102. In particular, first elastic cord 103 wraps around a front of pouch 101 through first anchor 102, around both lateral sides of pouch 101, and then down the back of pouch 101 through a slit 173B in a panel 171 of coupler 107. After extending into slit 173B, first elastic cord 103 extends between panel 171 and a rear sidewall 110 until an extension portion 137 of first elastic cord 103 emerges from behind panel 171 below pouch 101.

First elastic cord 103 is secured with a desired tension around pouch 101 with first tension adjuster 105. First tension adjuster 105 is configured to maintain a stretched portion 133 of first elastic cord 103 under a selected tension by selectively restricting first elastic cord 103 from moving relative to first tension adjuster 105. Stretched portion 133 of first elastic cord 103 is disposed between first anchor 102 and first tension adjuster 105.

As shown in FIGS. 1 and 2, first tension adjuster 105 is mounted to extension portion 137 of first elastic cord 103 below pouch 101. First tension adjuster 105 receives two portions of the elastic cord proximate terminal ends of first elastic cord 103. The first tension adjuster may receive portions of the first elastic cord in medial positions as well; that is, it is not necessary that the tension adjuster receive the elastic cord near terminal ends of the cord.

As apparent in FIGS. 1-3, 9, and 10, first elastic cord 103 extends along a majority of the pouch length when extending from first anchor 102 to first tension adjuster 105. First elastic cord 103 extends around opposite lateral sides of pouch 101 when extending from first anchor 102 to first tension adjuster 105. However, the first elastic cord may wrap around the pouch in different paths to modify the manner in which the first elastic cord retains the magazine in the pouch.

As depicted in FIGS. 1-3, second elastic cord 104 extends between first anchor 102 and the second anchor 108 over pouch opening 112. As further shown in FIGS. 1-3, second elastic cord 104 extends through eyelet 122 of second anchor 108, through first channel 190 in cord router 109, through the top channel in first anchor 102, through second channel 191 in cord router 109, and back through eyelet 122 of second anchor 108.

As shown in FIGS. 1-3, second elastic cord 104 overlies the ammunition magazine when the ammunition magazine is disposed in the pouch interior. Second elastic cord 104 and cord router 109 push down on a magazine or other item extending out of pouch 101. Accordingly, second elastic cord 104 and cord router 109 restrict the ammunition magazine or other item from exiting the pouch interior.

Second tension adjuster 106 secures the free ends of second elastic cord 104 together with a desired amount of tension in second elastic cord 104. Second tension adjuster 106 is configured to maintain a portion of second elastic cord 104 extending over pouch opening 112 under a selected tension to facilitate securing items in pouch 101. Second tension adjuster maintains the selected tension in second elastic cord by selectively restricting second elastic cord 104 from moving relative to second tension adjuster 106.

The elastic cords may be any currently known or later developed type of elongate tension bearing member. Suitable materials include rope, string, cord, bungee cords, straps, and chains. In preferred embodiments, the cords are elastic, but elasticity is not required. The size and shape of the cords will vary in different embodiments.

Tension Adjusters

The tension adjusters selectively restrict the elastic cords from moving relative to the tension adjusters to maintain the elastic cords at selected tensions. By selectively adjusting and fixing the tension of the elastic cords around an object in pouch 101, the elastic cords and the tension adjusters cooperate to selectively retain the object in pouch 101 and to selectively release the object from pouch 101.

As shown in FIGS. 1 and 2, first tension adjuster 105 mounts to first elastic cord 103. In particular, first tension adjuster 105 mounts to extension portion 137 of first elastic cord 103 below pouch 101.

Figure 9:
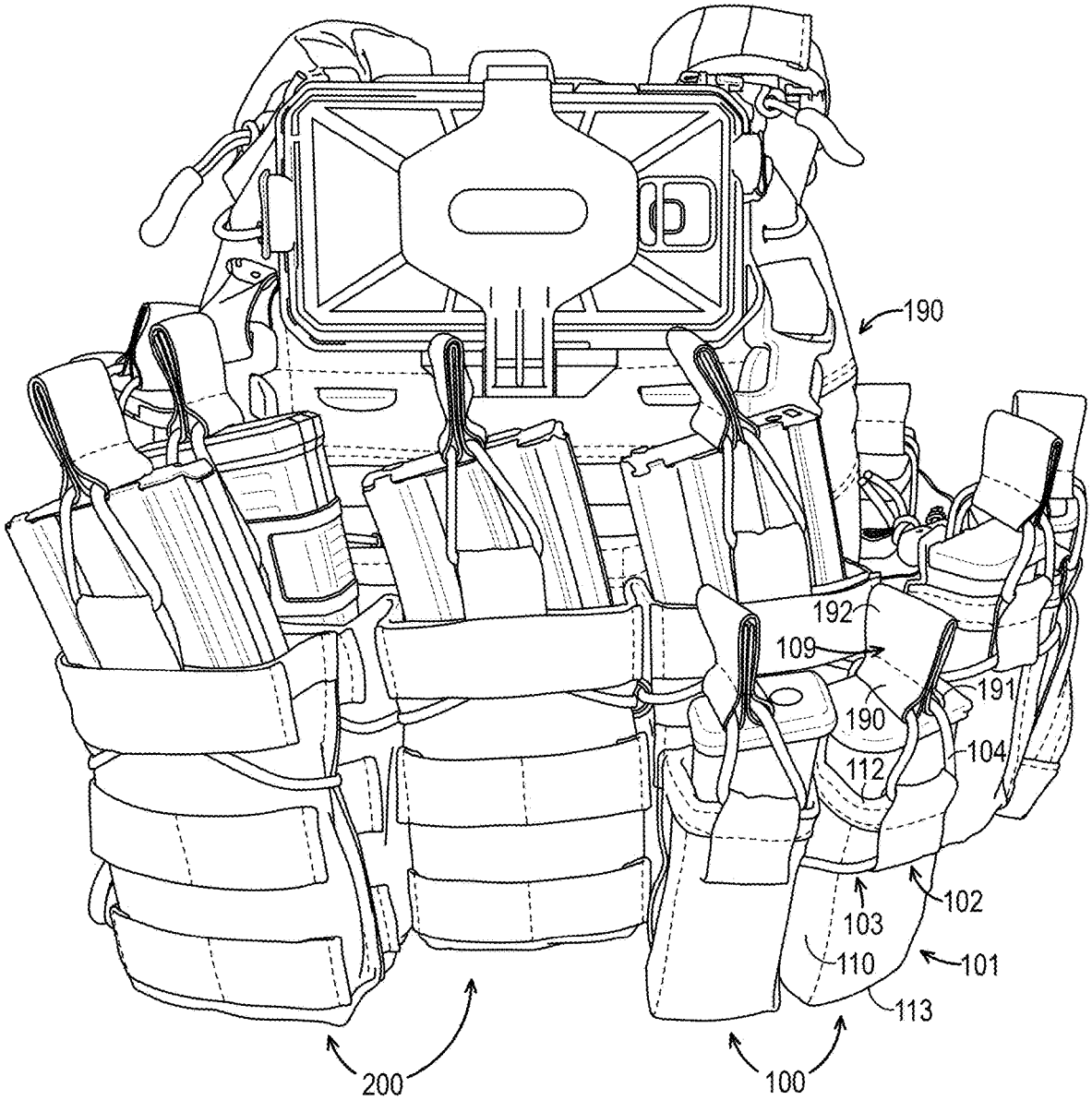
FIG. 9 is a front view of a plurality of magazine retention systems retaining different magazines and coupled together on a pack.
Figure 10:
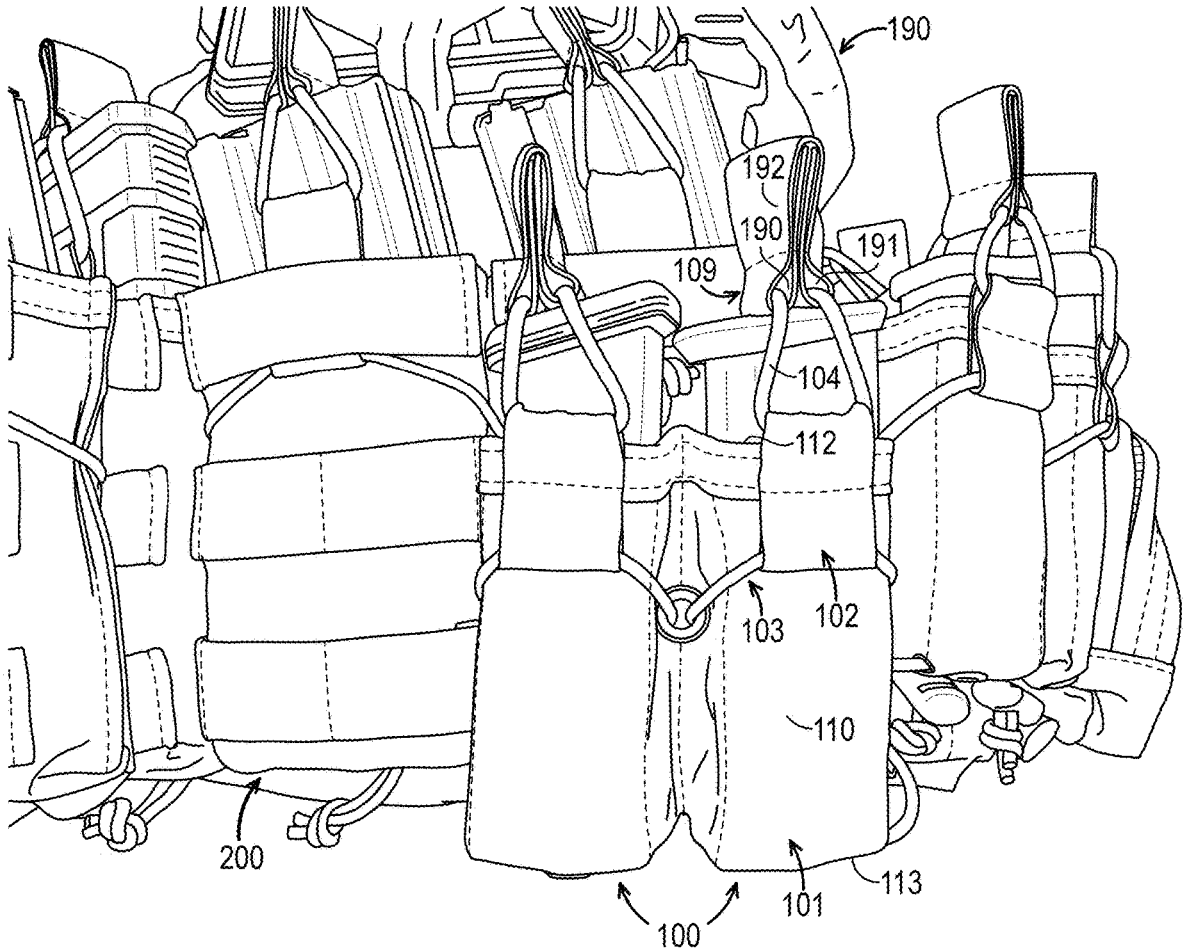
FIG. 10 is a close-up view of magazine retention systems coupled to a pack.

First tension adjuster 105 selectively fixes the tension of stretched portion 133 of first elastic cord 103. Stretched portion 133 of first elastic cord 103 is disposed between first anchor 102 and first tension adjuster 105. As shown in FIGS. 9 and 10, first elastic cord 103 loops around pouch 101 and compresses a magazine within pouch 101 when cinched tightly with first tension adjuster 105 around pouch 101 and the magazine therein.

In the example shown in FIGS. 1-3 and 10, first tension adjustor 105 is disposed proximate floor 113 of pouch 101. In particular, first tension adjuster 105 fixes the ends of first elastic cord 103 extending beyond coupler 107 and below pouch 101. However, the first tension adjuster may fix ends of the first elastic cord together at other locations instead.

Second tension adjuster 106 mounts to second elastic cord 104 and selectively fixes tension of second elastic cord 104. Second elastic cord 104 extends through top loop 121 of first anchor 102 and through the channels formed in cord router 109 over pouch 101. Second elastic cord 104 presses a magazine deeper within pouch 101 when cinched tightly around the magazine with second tension adjuster 106.

As shown in FIGS. 1-3, second tension adjuster 106 mounts to second elastic cord 104 on a side of second anchor 108 distal first anchor 102. Second tension adjuster 106 fixes the ends of second elastic cord 104 after the ends extend through eyelet 122 of second anchor 108. However, the second tension adjuster may fix ends of the second elastic cord together at other locations instead.

In the present example, the tension adjusters are cord cleats, which are also known as cord locks. However, the tension adjusters may be any currently known or later developed type of cord fastener or tension adjuster. Suitable tension adjusters include cord locks, cleats, toggle stoppers, and guyline cord adjusters. The tension adjusters may be any shape, size, or configuration suitable for a given application.

Coupler

As shown in FIGS. 9 and 10, coupler 107 functions to selectively couple pouch 101 to a pack and to other pouches. Coupler 107 is configured to selectively couple pouch 101 to other articles beyond packs or other pouches as well, such as belts, tactical vests, or military specification webbing. Coupler 107 also functions to provide structural support to the back of pouch 101.

Coupler 107 mounts to pouch 101. As shown in FIGS. 2 and 3, coupler 107 includes a strap 170 and a panel 171. Panel 171 is sewn to pouch 101, and strap 170 is integrally coupled to panel 171 at a first end 175 of panel 171. First end 175 is proximate pouch opening 112.

As can be seen in FIGS. 2 and 3, strap 170 includes a barbed head 176. As further shown in FIGS. 2 and 3, panel 171 defines a plurality of spaced slits 173A-173D (referenced generally as slits 173) along the length of panel 171. Different panel examples will define different numbers of slits, including more and fewer slits than depicted for panel 171. Spaced slits 173A-173D are complementarily configured with barbed head 176 of strap 170.

In more detail, barbed head 176 has a head width wider than a corresponding slit width of the selected slit 173D. In particular, the head width is wider than the slit width when barbed head 176 is oriented flat. The width of barbed head 176 can be made selectively narrower than the slit width by selectively bending barbed head 176. Reducing the head width to be narrower than the slit width enables barbed head 176 to be inserted or removed from slit 173D. Flattening barbed head 176 to have a width wider than slit 173D restricts barbed head 176 from pulling through slit 173D.

Barbs 174 of barbed head 176 cooperate with spaced slits 173A-173D to selectively fix a loop size of a coupler loop 177 of strap 170. Coupler loop 177 is defined by strap 170 when barbed head 176 inserts into a selected slit. The loop size of coupler loop 177 is the length of strap 170 between a selected slit 173 that receives barbed head 176 and first end 175 where strap 170 extends from panel 171. Strap 170 may be wrapped around a mounting point of a pack or other article, such as pack 190 shown in FIGS. 9 and 10, and then fixed in place within one of slits 173 to couple magazine retention system 100 to the pack or other article with coupler loop 177.

The reader can see in FIGS. 2 and 3 that first elastic cord 103 is routed through slit 173B of panel 171. However, first elastic cord 103 could be routed through any of slits 173A-173B. Routing first elastic cord 103 through the slits helps to guide and retain first elastic cord 103 in a desired position around pouch 101.

In the present example, panel 171 is formed from nylon, but may be formed from any durable material. Panel 171 is sewn to pouch 101 to couple coupler 107 to pouch 101.

Additional Embodiments

The discussion will now focus on additional magazine retention system embodiments. The additional embodiments include many similar or identical features to magazine retention system 100. Thus, for the sake of brevity, each feature of the additional embodiments below will not be redundantly explained. Rather, key distinctions between the additional embodiments and magazine retention system 100 will be described in detail and the reader should reference the discussion above for features substantially similar between the different magazine retention system examples.

Second Embodiment

Turning attention to FIGS. 4-10, a second example of a magazine retention system, magazine retention system 200, will now be described. As can be seen in FIG. 4-10, magazine retention system 200 includes a pouch 201, a first anchor 202, a cord router 209, a first elastic cord 203, a second elastic cord 204, a first tension adjuster 205, a second tension adjuster 206, a coupler 207, and a second anchor 208.

One distinction between magazine retention system 200 and magazine retention system 100 is that pouch 201 is larger than pouch 101. Pouch 201 also includes cross straps for lateral support not present in pouch 101. As shown in FIGS. 7-10, pouch 201 is configured to receive a larger magazine than pouch 101.

Figure 6:
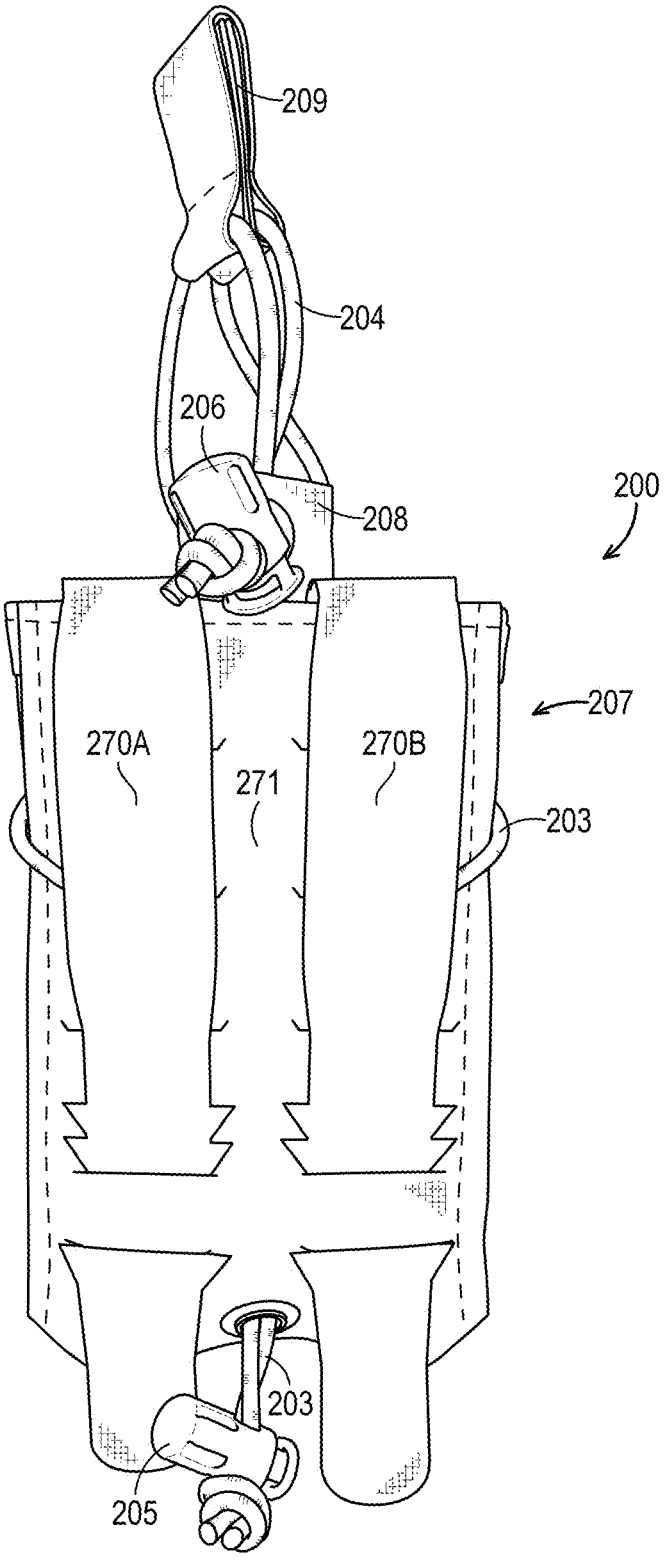
FIG. 6 is a rear view of the magazine retention system shown in FIG. 4.
Figure 7:
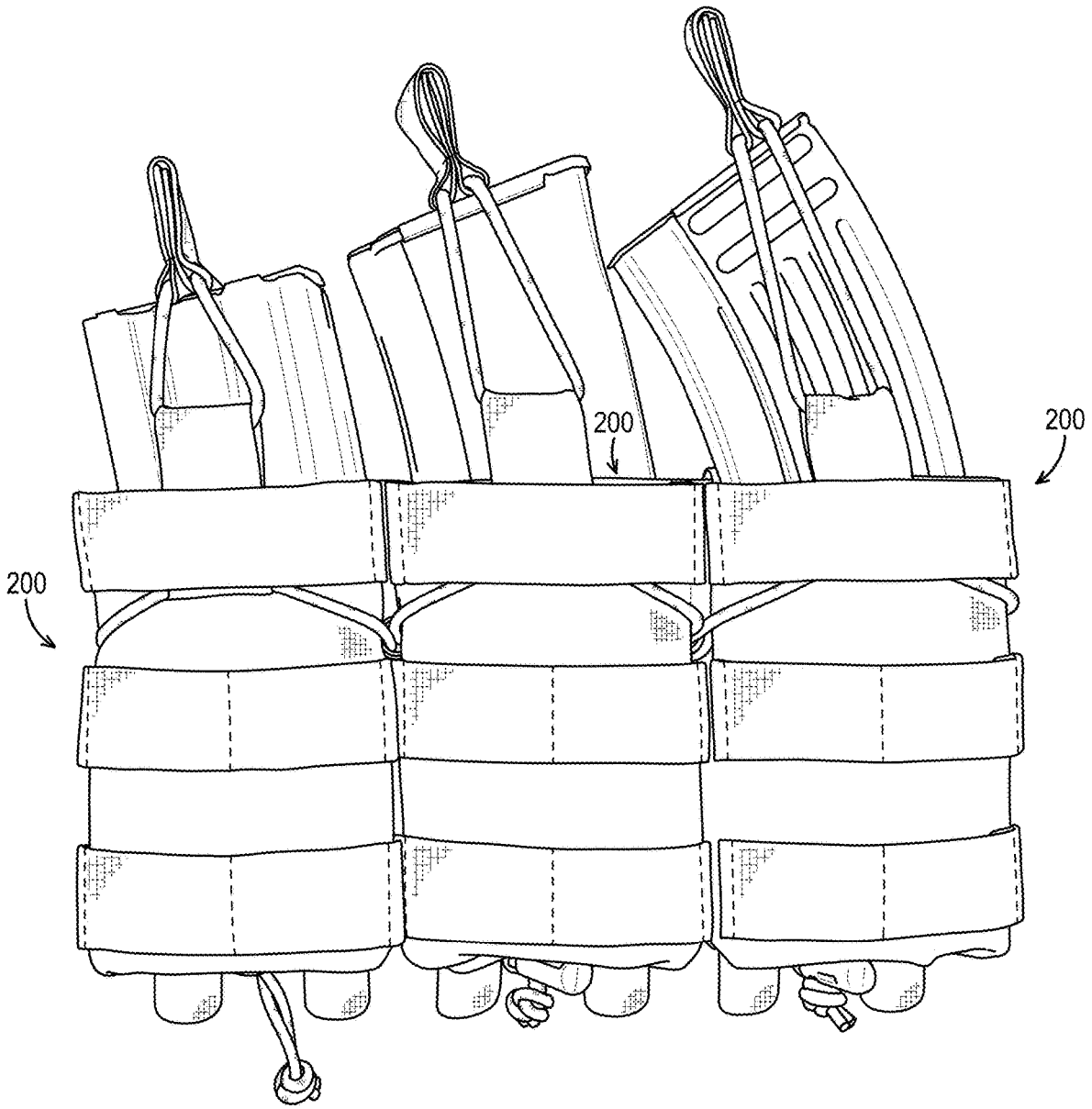
FIG. 7 is a front view of a set of three magazine retention systems configured as shown in FIG. 4 sewn together and retaining three different magazines.
Figure 8:
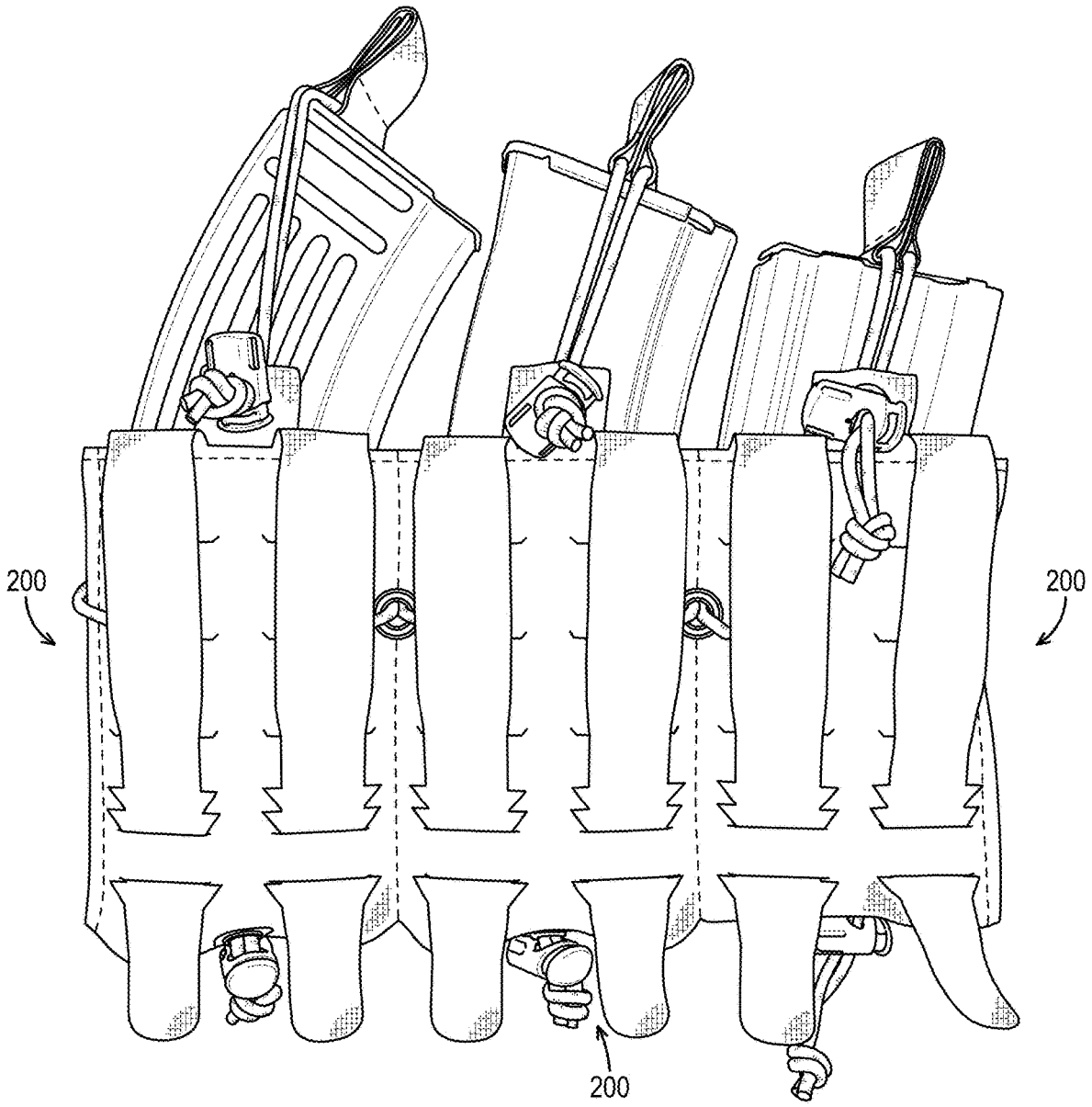
FIG. 8 is a rear view of the set of magazine retention systems shown in FIG. 7.

Another distinction between magazine retention system 200 and magazine retention system 100 is that coupler 207 is larger than coupler 107. As shown in FIG. 6, coupler 207 includes two straps 270A and 270B instead of one strap like strap 170 for magazine retention system 100. The larger panel 271 of coupler 207 complements the larger size of pouch 201.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A magazine retention system, comprising:

a pouch defining a pouch interior and configured to receive an ammunition magazine in the pouch interior, the pouch including:

sidewalls defining a pouch opening through which the ammunition magazine may be selectively placed within the pouch interior; and a floor coupled to the sidewalls opposite the pouch opening and cooperating with the sidewalls to define the pouch interior;

a first anchor coupled to the pouch;

a first elastic cord retained by the anchor and extending around the sidewalls;

a first tension adjuster mounted to the first elastic cord and configured to maintain a stretched portion of the first elastic cord under a selected tension by selectively restricting the first elastic cord from moving relative to the first tension adjuster;

a second anchor coupled to the pouch in a position spaced across the pouch opening from the first anchor and defining an eyelet;

a second elastic cord retained by the first anchor and extending over the pouch opening between the first anchor and the second anchor, the second elastic cord extending though the eyelet; and a second tension adjuster mounted to the second elastic cord on a side of the second anchor distal the first anchor;

wherein:

the first tension adjuster and the first elastic cord cooperate to selectively compress the sidewalls to secure the ammunition magazine in the pouch interior;

the second elastic cord overlies the ammunition magazine when the ammunition magazine is disposed in the pouch interior to restrict the ammunition magazine from exiting the pouch;

the second tension adjuster is configured to maintain a portion of the second elastic cord extending over the pouch opening under a selected tension by selectively restricting the second elastic cord from moving relative to the second tension adjuster; and the eyelet is smaller than the second tension adjuster to restrict the second tension adjuster from passing through the eyelet.

2. The magazine retention system of claim 1, wherein the first anchor is disposed proximate the pouch opening.

3. The magazine retention system of claim 2, wherein the first tension adjustor is disposed proximate the floor of the pouch.

4. The magazine retention system of claim 3, wherein:

the pouch has a pouch length extending from the pouch opening to the floor; and the first elastic cord extends along a majority of the pouch length when extending from the first anchor to the first tension adjuster.

5. The magazine retention system of claim 4, wherein the first elastic cord extends around opposite lateral sides of the pouch when extending from the first anchor to the first tension adjuster.

6. The magazine retention system of claim 5, wherein the first anchor defines a channel through which the first elastic cord extends at a medial portion of the first elastic cord.

7. The magazine retention system of claim 6, wherein the first tension adjuster receives two portions of the first elastic cord proximate terminal ends of the first elastic cord.

8. The magazine retention system of claim 1, wherein the stretched portion of the first elastic cord is disposed between the first anchor and the first tension adjuster.

9. The magazine retention system of claim 1, wherein the first tension adjuster is a cord cleat.

10. The magazine retention system of claim 1, wherein the first anchor is sewn to the pouch.

11. The magazine retention system of claim 1, wherein:

the magazine retention system further comprises a cord router mounted to the second elastic cord above the pouch opening;

the cord router defines a first channel and a second channel beside the first channel;

the first channel and the second channel extend in parallel;

a first portion of the second elastic cord passes through the first channel; and a second portion of the second elastic cord passes through the second channel.

12. The magazine retention system of claim 11, wherein:

the cord router includes a pull tab extending transverse from the first channel and the second channel;

the second elastic cord extending through the first channel and the second channel is disposed between the pull tab and the pouch opening; and pulling the pull tab away from the pouch opening spaces the second elastic cord from the ammunition magazine disposed in the pouch to allow the ammunition magazine to be selectively removed from the pouch.

13. The magazine retention system of claim 1, further comprising a coupler mounted to the pouch and configured to selectively mount the magazine retention system to an object.

14. The magazine retention system of claim 13, wherein the coupler includes:

a panel defining spaced slits and having a first end; and a strap coupled to the panel at the first end and complementarily configured with the spaced slits to selectively insert into a selected slit to define a coupler loop with a loop size defined by the space between the first end and the selected slit.

15. The magazine retention system of claim 14, wherein:

the strap includes a head distal the first end;

the head is complementarily configured with the spaced slits to selectively insert into the selected slit; and the head has a head width wider than a corresponding slit width of the selected slit when the head is oriented flat to restrict the head from pulling through the slit unless the head is selectively bent to reduce the head width to be narrower than the slit width.

16. The magazine retention system of claim 10, wherein the first anchor is sewn to the pouch with a stich that bisects the first anchor into two channels, each channel configured to receive one of the first elastic cord and the second elastic cord.

17. The magazine retention system of claim 16, wherein the first anchor includes:

a bottom channel through which the first elastic cord extends; and a top channel through which the second elastic cord extends.

18. A magazine retention system, comprising:

a pouch defining a pouch interior and configured to receive an ammunition magazine in the pouch interior, the pouch including:

sidewalls defining a pouch opening through which the ammunition magazine may be selectively placed within the pouch interior; and a floor coupled to the sidewalls opposite the pouch opening and cooperating with the sidewalls to define the pouch interior;

an anchor coupled to the pouch;

an elastic cord retained by the anchor and extending around the sidewalls; and a tension adjuster mounted to the elastic cord and configured to maintain a stretched portion of the elastic cord under a selected tension by selectively restricting the elastic cord from moving relative to the tension adjuster;

a coupler mounted to the pouch and configured to selectively mount the magazine retention system to an object, the coupler including:

a panel defining spaced slits and having a first end; and a strap coupled to the panel at the first end and complementarily configured with the spaced slits to selectively insert into a selected slit to define a coupler loop with a loop size defined by the space between the first end and the selected slit;

wherein:

the tension adjuster and the elastic cord cooperate to selectively compress the sidewalls to secure the ammunition magazine in the pouch interior;

the strap includes a head distal the first end;

the head is complementarily configured with the spaced slits to selectively insert into the selected slit;

the head has a head width wider than a corresponding slit width of the selected slit when the head is oriented flat to restrict the head from pulling through the slit unless the head is selectively bent to reduce the head width to be narrower than the slit width;

the elastic cord extends through one of the spaced slits away from the first end between the panel and the sidewalls until an extension portion of the elastic cord extends beyond the panel and the pouch; and the tension adjuster is mounted to the extension portion of the elastic cord extending beyond the panel and the pouch.

* * * * *